US005938179A

United States Patent [19]

Beukers et al.

[11] Patent Number: 5,938,179

[45] Date of Patent: Aug. 17, 1999

[54] BAG AND METHOD OF CONSTRUCTING THE SAME

[75] Inventors: Adriaan Beukers, Heemstede; Theo de Jong, Holland; Axel Maarschalk, Heemstede, all of Netherlands

[73] Assignee: Res Q Technology, Inc., St. Louis, Mo.

[21] Appl. No.: 09/053,367

[22] Filed: Apr. 1, 1998

Related U.S. Application Data

[63] Continuation-in-part of application No. 08/732,093, Oct. 15, 1996, abandoned, which is a continuation of application No. 08/248,882, May 25, 1994, abandoned.

[51] Int. Cl.[6] ..... B66F 3/24

[52] U.S. Cl. ..... 254/93 HP

[58] Field of Search ..... 254/93 HP, 93 R, 254/89 H

[56] References Cited

U.S. PATENT DOCUMENTS

| | | |
|---|---|---|
| 1,374,295 | 4/1921 | Fleury . |
| 1,752,101 | 3/1930 | Meutsch . |
| 2,070,960 | 1/1937 | Phillips . |
| 2,610,824 | 9/1952 | Grier . |
| 2,804,118 | 8/1957 | Bayerkohler . |
| 3,174,722 | 3/1965 | Alm . |
| 3,305,217 | 2/1967 | Wijerganas . |
| 3,521,861 | 7/1970 | Freudenthal et al. . |
| 3,695,582 | 10/1972 | Clay . |
| 3,744,756 | 7/1973 | Smith . |
| 4,036,472 | 7/1977 | Orndorff, Jr. . |
| 4,323,141 | 4/1982 | Ragan et al. . |
| 4,372,533 | 2/1983 | Knaus et al. . |
| 4,605,203 | 8/1986 | Hooper et al. . |
| 4,770,095 | 9/1988 | Schofield . |
| 4,907,781 | 3/1990 | Vetter . |
| 5,067,774 | 11/1991 | Trowland . |
| 5,178,367 | 1/1993 | Vaughen . |

FOREIGN PATENT DOCUMENTS

| | | |
|---|---|---|
| 0 345 450 | 4/1989 | European Pat. Off. . |
| 2305381 | 3/1975 | France . |
| 2269487 | 5/1975 | France . |
| 37 03 593 | 10/1987 | Germany . |
| 4046839 | 2/1992 | Japan . |
| 4046840 | 2/1992 | Japan . |
| 1134033 | 6/1966 | United Kingdom . |
| 1169023 | 10/1969 | United Kingdom . |

OTHER PUBLICATIONS

Zickel, ARB Journal, "Isotensoid Pressure Vessels," 6/19, pp. 950–951.

Dabinett, "The Design and Analysis of Filament Wound Axisymmetric Structures," Jun. 24–26, 1991, 27th Joint Propulsion Conference, 3 pages.

Th.De Jong, "A Theory of Filament Wound Pressure Vessels," Apr. 1983, 2 pages.

vol. 1., Polymer Composites, Section VI, Chapter 29, "Design of Filament Wound Pressure Vessels," Feb. 29, 1994, 3 pages.

*Primary Examiner*—Robert C. Watson

*Attorney, Agent, or Firm*—Senniger, Powers, Leavitt & Roedel

[57] ABSTRACT

A geometrically-shaped bag for lifting and positioning objects has a layer of fluid impermeable, non-porous material forming an expandable bladder having opposite ends and a first layer of wound strands enclosing the expandable bladder. A method of manufacturing the bag comprises the steps of providing a geometrically-shaped mold member having an axis of rotation extending through opposite ends of the mold member, coating the mold member with fluid impermeable, non-porous material to form an expandable bladder having opposite ends, winding a first layer of strands onto the mold member over the expandable bladder, and removing the mold member from the expandable bag.

21 Claims, 8 Drawing Sheets q=30
q=2.5
q=7.5
q=50
q=100
($Y_0$ = 60 MM)
$Y_0$
400
300
200
100
0
X (MM)
0
100
200
300
400
500
600
700
Y (MM)

BAG AND METHOD OF CONSTRUCTING THE SAME

CROSS-REFERENCE TO RELATED APPLICATIONS

This application is a continuation-in-part of Ser. No. 08/732,093 filed Oct. 15, 1996, abandoned, which is a continuation of Ser. No. 08/248,882 filed May 25, 1994, abandoned. Both applications are incorporated herein by reference.

This application is based on European Application No. 93201518.3 for Lifting Body, filed May 26, 1993, the entire disclosure of which is incorporated herein by reference.

SUMMARY OF THE INVENTION

The present invention is directed to an inflatable bag and a method of constructing the same.

Lifting bodies are used for lifting and positioning heavy objects, for example, parts of collapsed structures under which persons have become wedged. Common occurrences for which the lifting bag may be used can be in earthquakes, collapsing of buildings, airplane disasters, train accidents, and the like. In such situations, usually only a very narrow entrance is present for applying a lifting apparatus. In such situations, inflatable lifting bodies, or bags, are used since they are capable of assuming very flat configurations in their deflated condition.

Other applications of the use of lifting bags, or lifting bodies, are for moving or positioning heavy machinery (e.g., mining equipment), changing tires, lifting and levelling of buildings, and uprighting of locomotives and vehicles. They may also be used in construction for forcing steel beams apart or for pressing together ship segments/plates for welding.

Presently, there are generally two types of lifting bags, high pressure and low pressure bags. The low pressure bags give an equal lifting capacity over the total lifting height. Moreover, due to the limited force per unit area, there will be no damage of weak surfaces. The lifting capacity depends on the size of the contact area.

A low pressure bag acts on a large area and usually operates at an air pressure of about 0.2 bar to 1.0 bar in excess of atmospheric pressure. Low pressure bags can achieve lifting heights of approximately 25 cm to 300 cm with lifting capacities of about 16 tons.

The high pressure lifting bags give a high lifting capacity on a relatively small area with a limited lifting height. High pressure bags, usually prepared from vulcanized rubber reinforced with high tensile polyamide cord operate at air pressures in excess of 5 bars, up to 12 bars. The lifting capacities of those high pressure bags usually range from 10 tons, up to 75 tons.

The maximum lifting height is however limited since the force exerted by the bag acts on a small area. Thus, weak surfaces could become damaged if pressed against rough surfaces. Additionally, the high pressure lifting bags typically change in geometry when inflated, from a flat, rectangular shape, via a pillow shape, to a spherical shape, when fully inflated. The corners of the bag are the limiting weak spots.

It will be clear that depending on the requirements of the situation, either high pressure or low pressure systems are used. With the high pressure systems the disadvantage exists that the lifting force decreases upon increase of the lifting height, due to the decreasing surface area. During rescue operations, usually a constant, high lifting force is required over a large lifting height.

Among the several objects of this invention may be noted the provision of a bag for lifting objects having a large lifting capacity over a reasonably large lifting height; the provision of such a bag having substantially less weight per unit of lifting power; the provision of such a bag which is resistant to catastrophic failure when punctured; the provision of such a bag having a shaped surface contoured for lifting like-shaped objects; the provision of such a bag which is capable of being grouped together with identically constructed bags and a platform to lift and position objects; and the provision of such a bag which is durable, light-weight and easy to use.

Among the several objects of this invention may also be noted the provision of a method for constructing a bag for lifting and positioning objects which is cost-efficient and produces a strong, durable bag.

Generally, a geometrically-shaped bag for lifting and positioning objects comprises a layer of fluid impermeable, non-porous material forming an expandable bladder having opposite ends and a first layer of wound strands enclosing the expandable bladder.

In general, a method of manufacturing a bag for lifting and positioning objects comprises the steps of: (a) providing a geometrically-shaped mold member having an axis of rotation extending through opposite ends of the mold member; (b) coating the mold member with fluid impermeable, non-porous material to form an expandable bladder having opposite ends; (c) winding a first layer of strands onto the mold member over the expandable bladder; and (d) removing the mold member from the expandable bag.

In another aspect of the present invention, the method comprises the steps of: (a) providing a geometrically-shaped mold member having an axis of rotation extending through opposite ends of the mold member; (b) winding a first layer of strands onto the mold member; (c) removing the mold member from the first layer of strands; and (d) inserting an expandable bladder constructed of fluid impermeable, non-porous material into the first layer of strands.

An apparatus for lifting and positioning objects comprises a plurality of bags having bottom and top ends. The bags are positioned adjacent one another. A platform has a top surface adapted to engage an object for lifting and positioning the object and a bottom surface engaging the top ends of said bags.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1A:
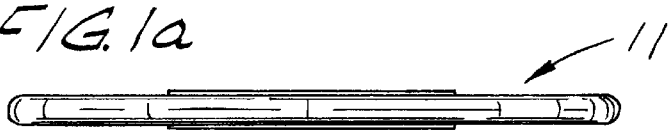
FIG. 1*a* is an elevation view showing a bag of the present invention in flattened condition.
Figure 1B:
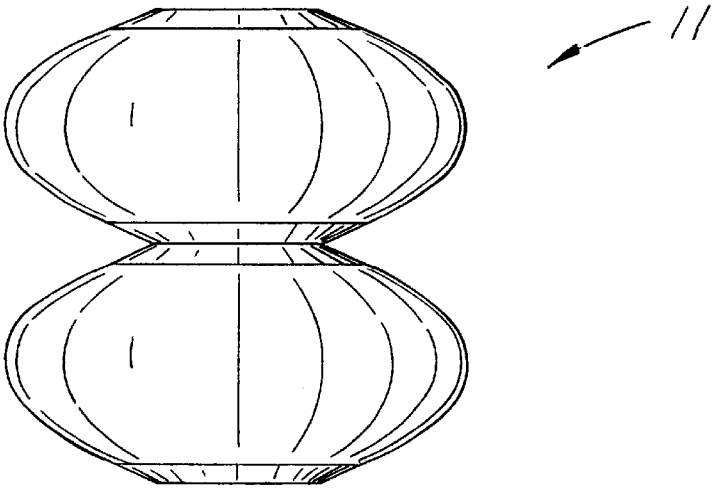
FIG. 1*b* is an elevation view showing the bag illustrated in FIG. 1*a* in inflated condition with a second bag of identical construction being shown on top of and in stacked relationship therewith.
Figure 2:
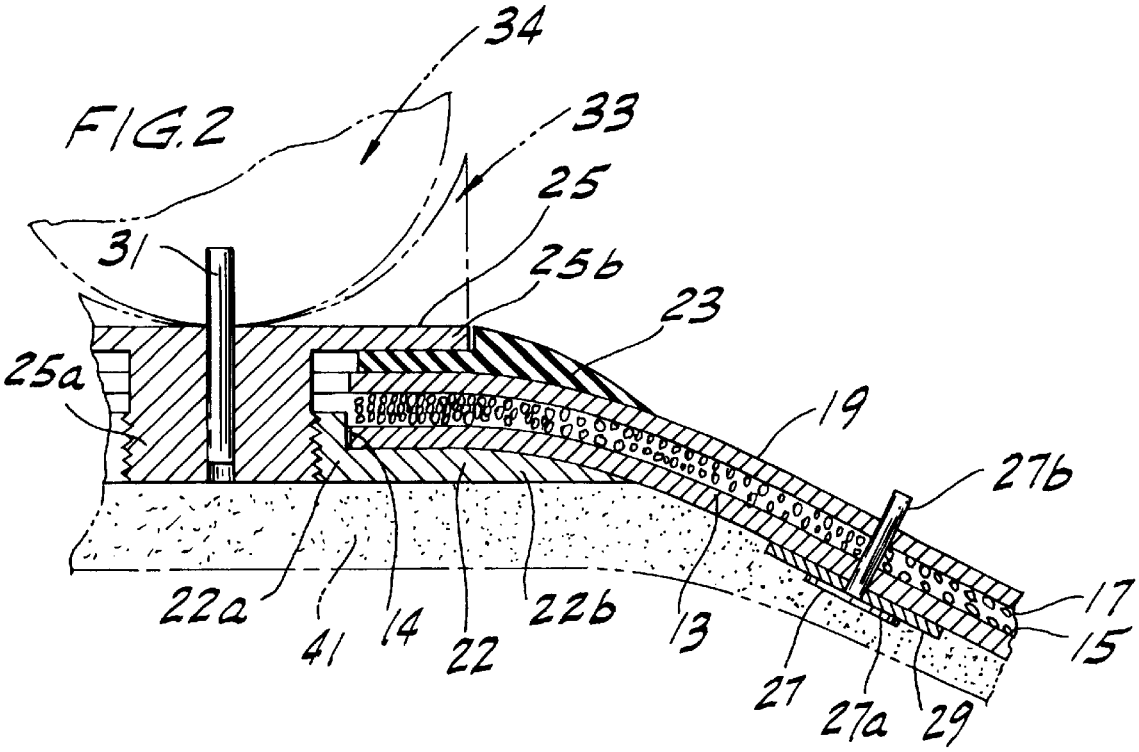
FIG. 2 is a cross section of an end of the bag illustrated in FIG. 1*b;*
Figure 3:
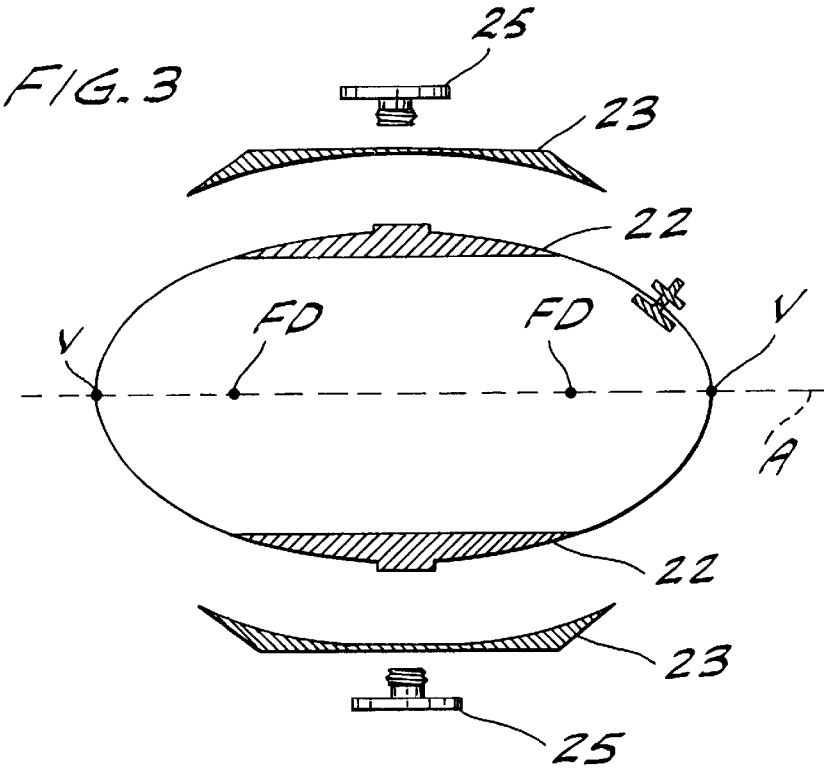
FIG. 3 is an exploded view of the bag illustrated in FIGS. 1*a* and 1*b;*

Referring to the drawings, and more particularly to FIGS. 1–3, a geometrically-shaped bag of the present invention is indicated in its entirety by the reference numeral 11. The invention is directed to a bag comprising a seamless wall having a layer of fluid impermeable, non-porous material (e.g., rubber) forming an expandable bladder 13 having opposite ends with openings 14 formed therein. The geometrically shaped bag 11 for lifting and positioning objects and for filling voids, and comprises a fiber reinforced elastomer body. The elastomer body, having a seamless wall, in its uninflated condition has a substantially flat shape (FIG. 1*a*) in which opposite ends of the bag are adjacent one another. The wall of the bag, in its inflated condition (FIG. 1*b*), has a generally ellipsoidal-shaped configuration, which is at mechanical equilibrium, predominantly geometrically continuous, nonspherical, and noncylindrical. Only the ends of the bag and/or the below-identified components of the bag used to inflate the bag will form discontinuities in the shape of the body of the bag.

The expandable bladder 13 can be any suitable elastomer, although it is preferred that a high quality elastomer having a good resistance against environmental degradation, such as ozone resistance, is used. Suitable elastomers are for example isoprene, polyurethane, styrene butadiene, butadiene-nitrile, EP(D)M, polybutadiene and silicone elastomers, which are optionally vulcanized after the bag has been shaped.

As mentioned above, the wall of the inflatable bag comprises an expandable, rubber bladder 13. More specifically, the wall has two vertexes V and two focal points FP extending along an axis generally perpendicular to an axis A of rotation extending between the two ends of the expandable bladder. The generally flat ends of the bag lie in a plane generally parallel to the axis upon which the vertexes and focal points of the ellipsoidal-shaped wall of the expandable bladder 13 lie (and is generally perpendicular to the axis of rotation of the bladder). It is to be understood that the ellipsoidal-shaped wall may have differing vertexes and focal points from the wall illustrated in the drawings, thereby forming bags having varying shapes.

Referring to FIGS. 2 and 3, the wall further comprises a first layer 15 of wound strands enclosing the expandable bladder 13. The strands of the first layer are wound along substantially geodetic lines, and the shape of the wall of the inflated bag is designed so that the load is substantially equal from strand to strand (more or less "isotensoidal"). The strands can be constructed from various materials, generally comprising natural or synthetic organic fibers, although the well-known aramid fibers, such a Kevlar™ and Twaron™ are a suitable choice. Those fibers give the strands sufficient tensile stiffness in combination with strength. Other suitable fibers should have a high tensile strength and/or stiffness, such as sisal, carbon fibers, E-, R- and S-glass fibers, and those polymeric fibers which are suitable in the environments where the bags are used, such as the high molecular weight polyethylene fibers, polyester fibers and other fibers from high quality plastics (engineering plastics). The Young's Modulus of the strands are substantially higher than the modulus of the rubber bladder 13. The combination of relatively stiff strands and flexible expandable bladder is chosen in such a way that the design, production and use of the inflatable bag is very tolerant for deviations and stress-concentrations in the inflatable bag. Deviations of geodetic and/or continuity becomes possible to a certain extent, provided the structural integrity is maintained. This method of winding strands onto an object in the manner which will be described in greater detail below has sometimes been referred to as "netting".

The wall of the bag further includes a second layer 17 of wound strands enclosing the first layer 15 of strands. Preferably, first and second layers of wound strands are fabricated from aramid which is commonly sold by duPont under the trademark "Kevlar". Before being wound onto expandable bladder 13, the strands of the first layer 15 and second layer 17 of wound strands are impregnated with rubber. By impregnating the first layer 15 of wound strands with rubber, the strands are adapted to remain attached to the expandable bladder 13. Similarly, the impregnated second layer 17 of wound strands are adapted to remain attached to the first layer 15 of wound strands. The second layer of wound strands are twisted before being wound onto the first layer of wound strands and the bladder. The first and second layers of strands are constructed and arranged on the expandable bladder so that each strand of the first and second layers of strands is substantially equally tensioned for reducing the possibility of catastrophic failure of the bag when punctured (i.e., isotensoidal). The strands are capable of moving over the expandable bladder 13 in such a way that when the bladder is punctured, strands adjacent the punctured opening reinforce the area of the bladder around the opening to prevent enlargement of the opening due to air under pressure being forced through the opening.

As discussed above, each end of the expandable bladder 13 has an opening 14 formed therein and, to reinforce the ends of the bag, the first layer 15 and second layer 17 of strands form a concentrated area 18 around the openings of the expandable bladder. Thus, there is an opening at each end of the bag formed by the first and second layers of strands which is coaxial with the opening formed in the expandable bladder. Each opening has a center located along an axis extending through the ends.

A resistance layer 19, for example, neoprene, is applied over the second layer 17 of strands for protecting the strands and the expandable bladder 13. More specifically, this resistance layer 19 protects the expandable bladder 13 against penetration by foreign objects. Preferably this outer liner is able to withstand mechanical and thermal abuse without early collapse. In practice this means that the outer liner 19 must provide the bag with the possibility to withstand temperatures up to 150° C., surface pressures of a least 7.5 N/mm$^2$ and preferably also resistance against chemicals, such as oils, acids, lye, fats and the like.

Still referring to FIGS. 2 and 3, the bag further comprises end means positioned within each opening 14 for engaging at least the bladder 13 and the first layer 15 and for sealing the openings 14 so that bladder 13 forms a closed chamber which is fluid-tight. The end means includes two end caps 22, one for each end of the expandable bladder 13, adhered (e.g., by an industrial strength cement) to an inner surface of the expandable bladder for closing the respective openings. As illustrated best in FIG. 2, each end cap 22 includes a hub 22*a* having a threaded (female) opening formed therein and a flange 22*b* extending radially outwardly from the hub. The expandable bladder 13, first layer 15 and second layer 17 of strands and resistance layer 19 are adhered to the flange 22*b* of each end cap and therefore strengthening the ends of the bag.

Two annular disks 23, one for each end of the expandable bladder 13, are mounted onto the expandable bladder in a position such that edges of the resistance layer 19, first layer 15 and second layer 17 of strands and the expandable bladder are positioned between each end cap 22 and its associated annular disk. The annular disks 23 are provided for strengthening the ends of the expandable bladder 13 thereby enhancing its lifting capacity. Two end plates 25, one for each end of the expandable bladder, are mounted on respective end caps 22. Each end plate includes a threaded (male) hub 25*a* and a flange 25*b* extending radially outwardly from the hub. The male hub 25*a* of the end plate is threaded into the female hub 22*a* of the end cap in a position such that the flange of the end plate overlies the annular disk 23 for sandwiching the annular disk, resistance layer 19, first layer 15 and second layer 17 of strands including the concentrated area 14 and the expandable bladder 13 between the end plate 25 and the end cap 22.

The end caps 22, annular disks 23 and end plates 25 are fabricated from rigid, light-weight material, such as aluminum. However, it is to be understood that these components of the bag may be made from other rigid, light-weight materials, such as plastic.

The end plates 25 may also be formed with an upwardly-facing, shaped adapter 33 which is contoured to receive a shaped object for lifting the object. For example, the adapter illustrated in phantom in FIG. 2 is contoured to receive a large pipe 34. However, it is to be understood that the adapter may be formed with different shapes depending upon the shape of the object that requires lifting or positioning. In the shown embodiment, the pipe 34 rests upon the adapter 33.

A valve 27 is adhered to the inner surface of the expandable bladder and extends through the bladder, first layer 15 and second layer 17 of strands and the resistance layer 19 for inflating and deflating the bag. The valve 27 is a one-way valve of conventional construction. A reinforcement patch 29 is disposed between a flange 27*a* of the valve and the expandable bladder 13, the patch protecting the bladder from the edges of the flange of the valve. The valve further includes a valve stem 27*b* which extends through the bladder, first layer 15 and second layer 17 of strands and resistance layer 19. The valve stem 27*b* is provided for receiving the nozzle of a compressor (not shown) or other like apparatus for inflating the bag.

The expandable bladder 13 comprises a chamber which is constructed to receive and contain fluid (e.g., compressed air) for expanding the bladder. Each end plate 25 has a threaded opening formed therethrough which is constructed to receive a rod 31 for attaching the end plate to an end plate of a second bag in a position such that the first bag rests upon the second bag (illustrated in FIG. 1*b*). As illustrated in FIG. 2, the rod 31 is solid for isolating the chamber of the first bag from the chamber of the second bag. The rod may also be tubular so that the chamber of the first bag is in fluid communication with the chamber of the second bag. Thus, the tubular rod 31 enables the first bag to be pressurized with fluid to a pressure substantially equal to the pressure of the second bag.

The so-called "netting" theory discussed above has been used for this design. This theory teaches that in case of the use of stiff fibers forming strands arranged around the expandable bladder in matrix, the influence of the matrix may be discounted for calculating the forces in a system of strands of a wound construction. This theory is valid when the stiffness of the matrix is negligibly small compared to the stiffness of the strands.

Winding the substantially continuous fiber strands along a substantially rotation symmetrical wall results then in an equilibrium shape that is non-spherical, preferably approximately ellipsoidal. In view of the applicability of the netting theory to the bag of the present invention, which is justified by the difference in stiffness between the strands and the bladder, the use of continuous strands for the winding of the wall will lead to the situation where the tension in all the strands is substantially equal throughout the wall (isotensoidal).

Figure 12:
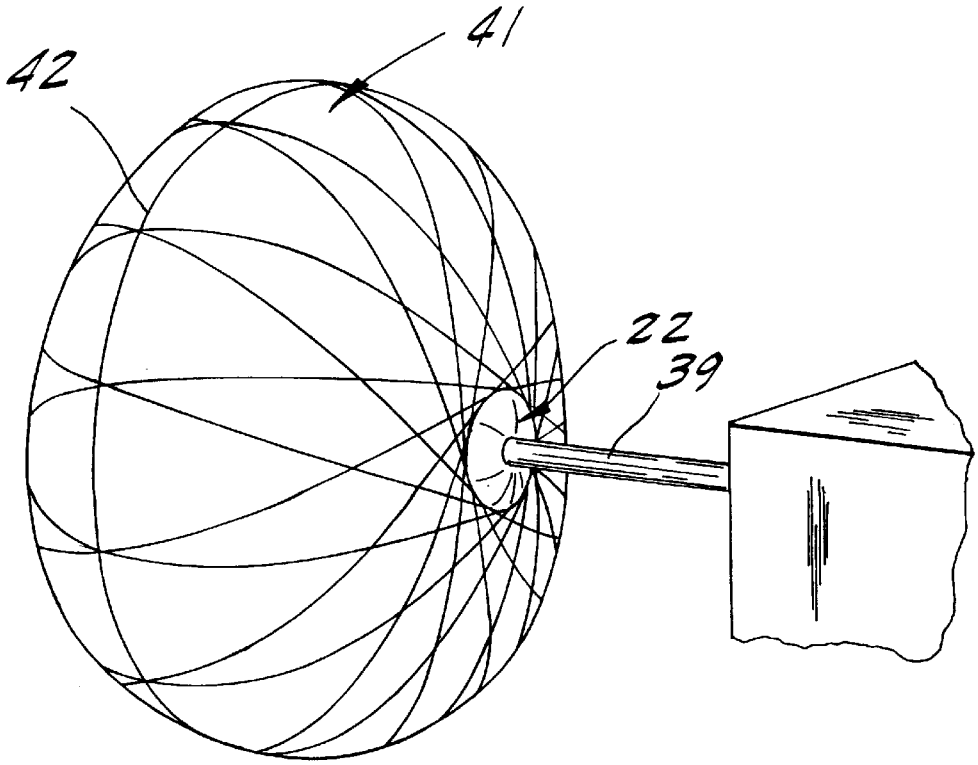
FIG. 12 is a perspective view of a mandrel and a mold member used in the manufacture of the bag.

In the prior art high pressure bags the fiber strands are cross-ply (0–90°), which is totally different from the isotensoidal winding of the present invention. As illustrated in FIG. 12, the strands forming the first layer 15 and second layer 17 of strands are non-parallel and form angles at the middle of the wall which are greater than 90°.

The inflatable bag according to the invention may be used as lifting bag, as discussed hereinabove, but also for other applications wherein high pressure inflatable bags can be useful. Examples thereof are lightweight, crash resistant pressure vessels, for example for holding hazardous gases or liquids under high pressure, such as gaseous, liquified or liquid propellants in the automotive and aerospace industry. The vessel can be fire proof by the choice of the materials of construction thereof, or by providing a metal or other fire proof box around the vessel.

Another example, as described above, is the use of multiple bags with the connecting rod 31 whereby, with a tubular rod, the rigidity of each bag may be adjusted by changing the pressure in each bag. A high pressure in the chamber of the bag provides a high rigidity and a low pressure in the chamber of the bag provides a relatively low rigidity. This adjustability of rigidity also makes it possible to have connection with less narrow tolerances. It is also possible to use the bag according to the invention as a plug or sealing closure in pipes etc. (e.g., fill a void).

The pressure in the inflatable bag will be applied by suitable means known in the art, like by air or another suitable pressurizing medium, for example another gas or a liquid medium (e.g., non-compressible fluid), such as water.

The lifting bag has a geometrically continuous shape in inflated condition without external load. In unloaded equilibrium condition substantially no stress concentrations occur. The shape of the bag contains substantially no discontinuities in the mathematical sense, with the exceptions discussed above. This excludes for example cylindrical bodies, or rectangular bodies.

To enable the closed expandable bladder 13 to hold gases or liquids, an air/liquid-tight inner liner (not shown) may be present, although it is also possible to use a bladder that is air/liquid-tight. The valve 27 is located in a place where generally no lifting force is applied. This valve will of course be connected air/liquid-tight with the expandable bladder.

The volume of the bag in unloaded, inflated condition is given by $$V=2\pi Y_o^3/3*\sqrt{((q^2+q+1)^5/(q^2+q)^3(2q+1))}*\int_0^{\pi/2}\sqrt{(1-(q-1)/(2q+1)*\sin^2\theta)}*d\theta$$

wherein q is defined as $$q=Y_u^2/Y_i^2$$

Figure 6:
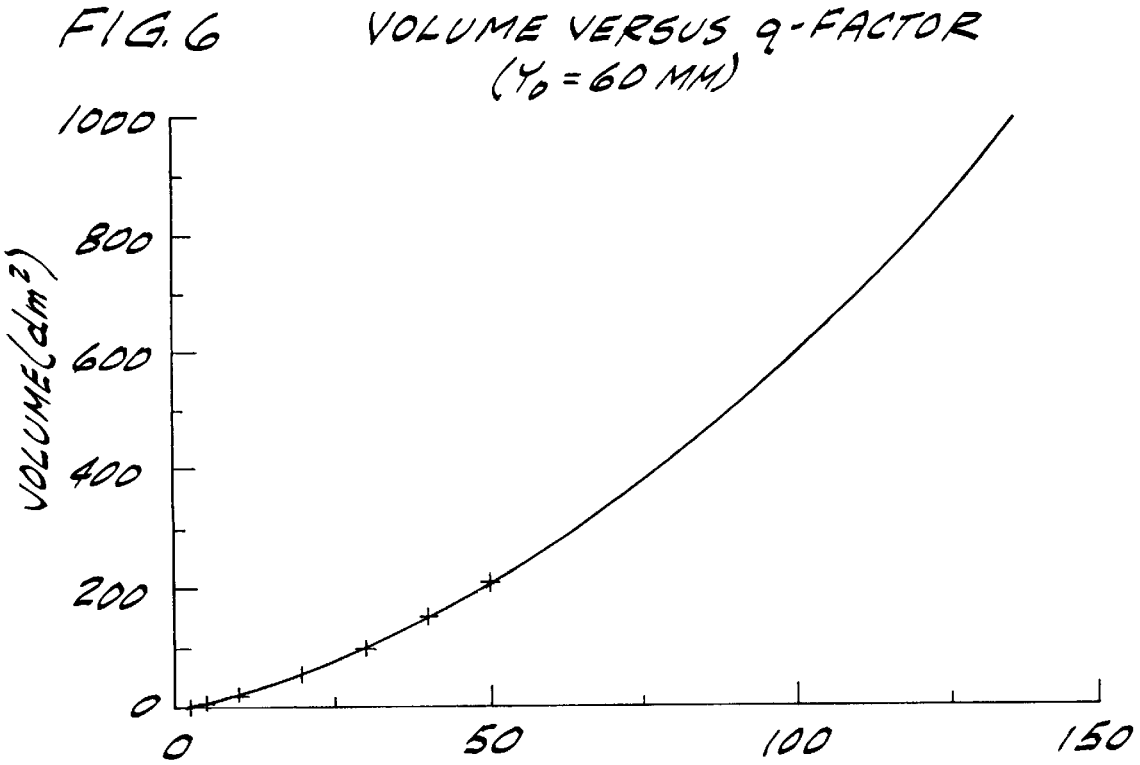
FIG. 6 is a graph showing volume versus q-factor.
Figure 4:
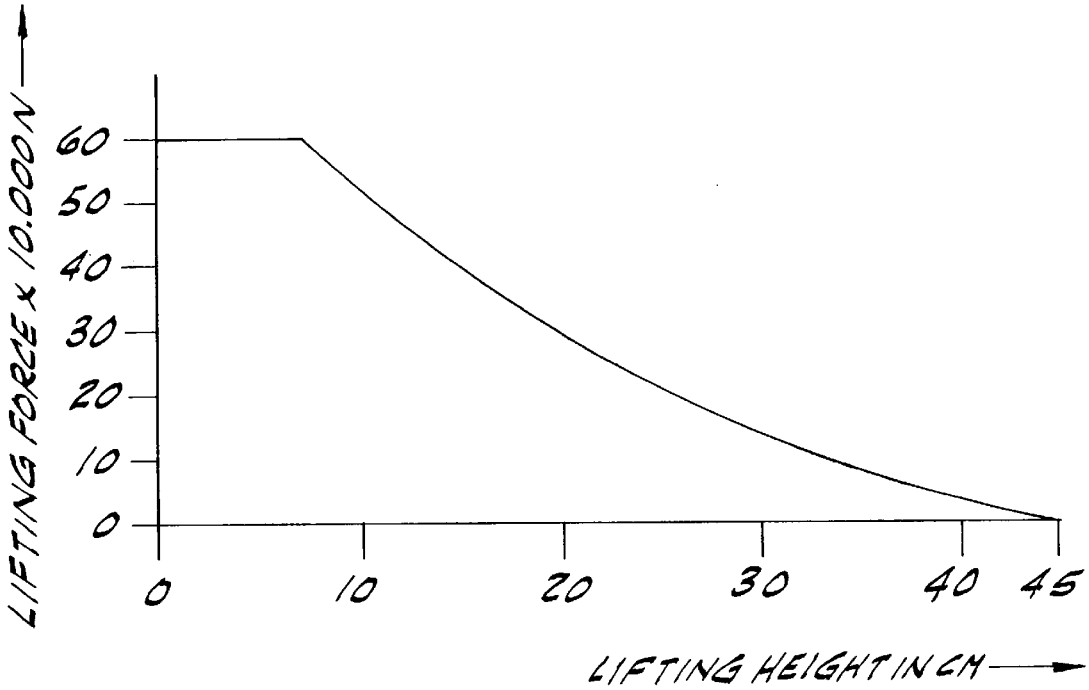
FIG. 4 is a graph showing the relationship between lifting force and lifting height of a prior art air bag.
Figure 5:
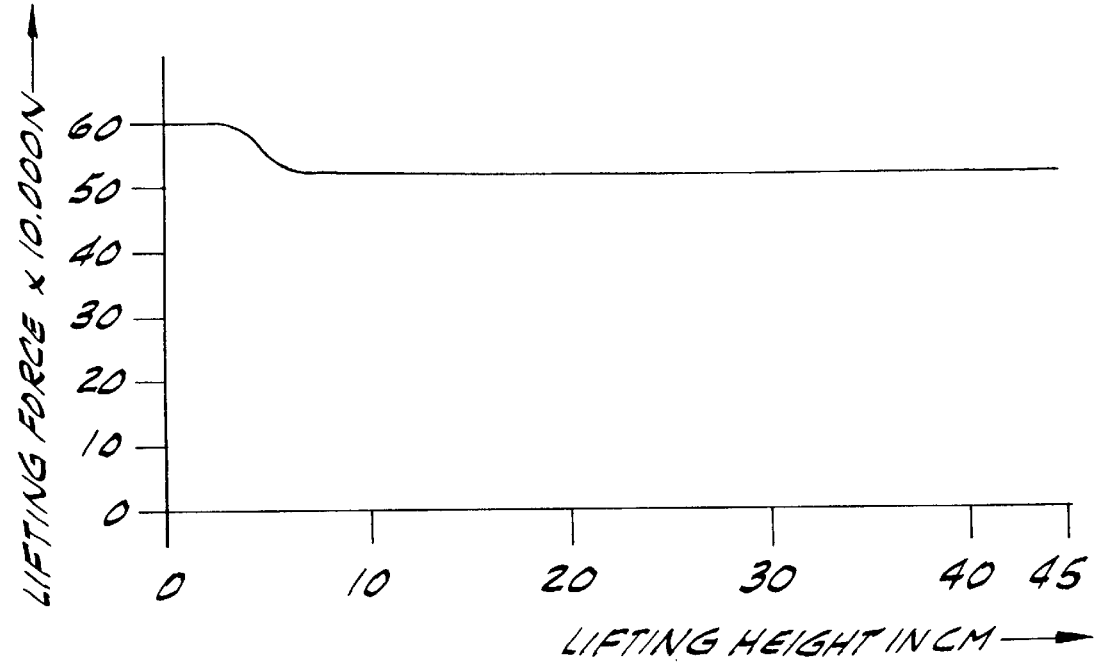
FIG. 5 is a graph showing the relationship between lifting force and lifting height of the bag of the present invention.
Figure 7:
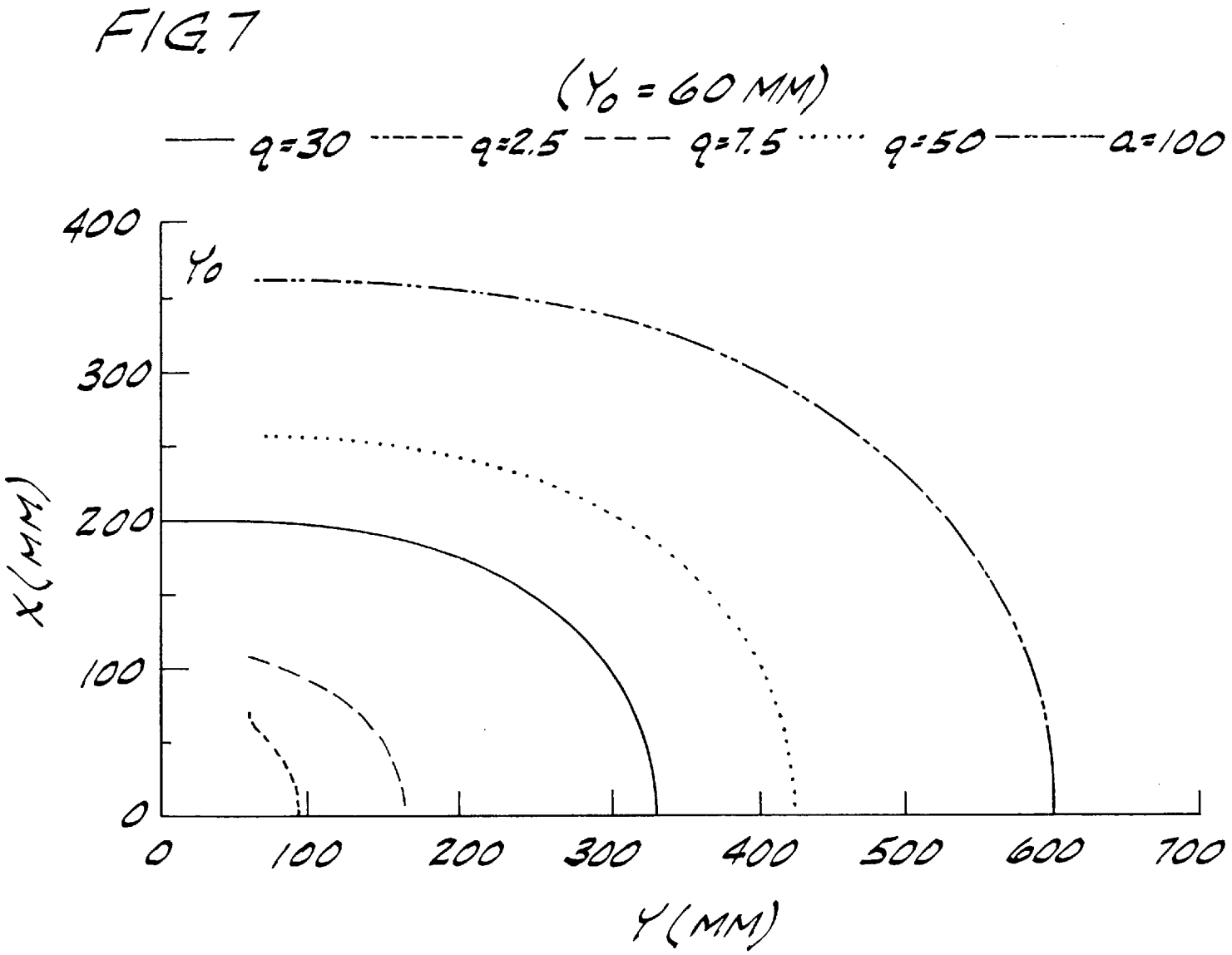
FIG. 7 is a graph showing the shape of the bag for various values of q.
Figure 8:
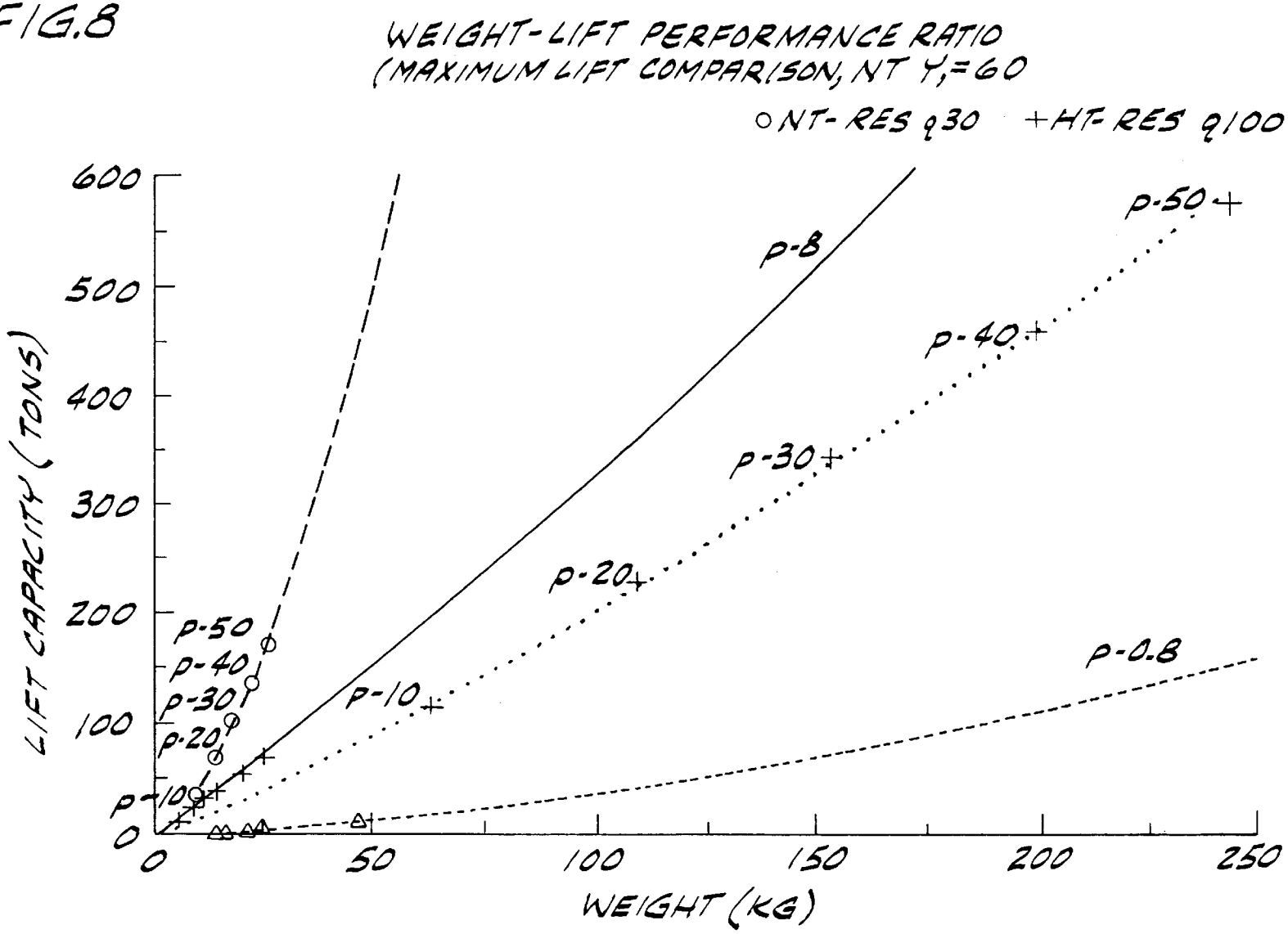
FIG. 8 is a graph showing weight-lift performance ratio.

$Y_o$ is the diameter of the pole opening, $Y_u$ is the smallest radius of the optimal part of the pressure vessel, and $Y_i$ is the largest radius of the optimal part of the pressure vessel. The volume of the bag for $Y_0$ is 60 mm as a function of q is given in the attached FIG. 6. The shape of the bag for $Y_0$=60 mm and with various values of q is given in the attached FIG. 7. In FIG. 8, the lifting capacity is given for $Y_0$=60 mm and q is 30 and 100.

Figure 11:
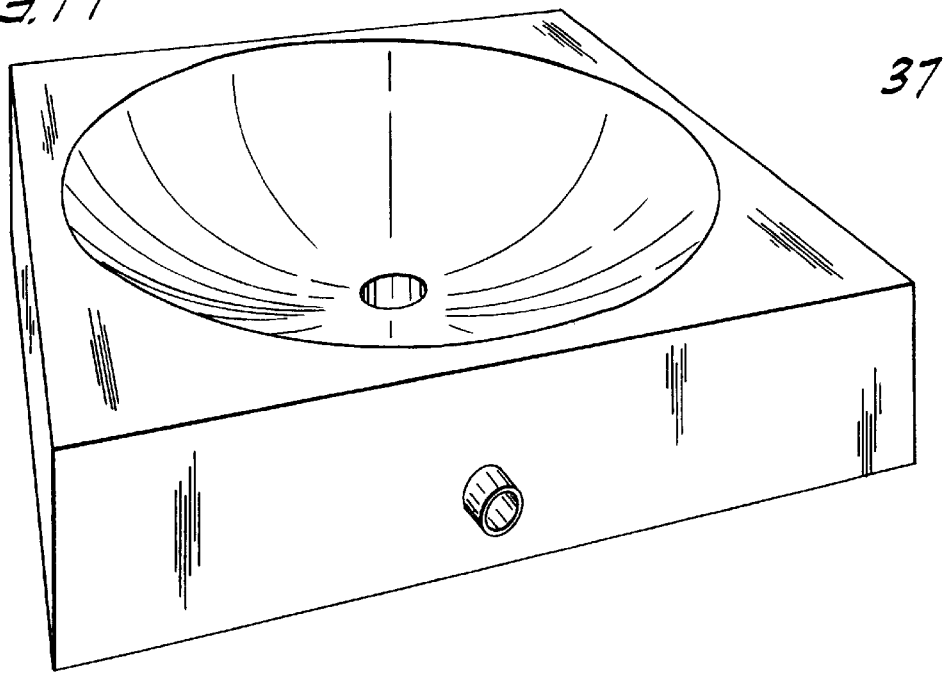
FIG. 11 is a perspective view of a die used to construct a mold member.

A method of manufacturing the above lifting bag is as follows. Illustrated in FIG. 11 is a die 37 from which a mold member 41 is fabricated. The mold member (see FIGS. 2 (phantom), 10 and 12) comprises sand and a binder for hardening the sand. The mold member 41 is formed in two halves which are joined together at outer edges by a binder 42. The mold member is geometrically-shaped (i.e., ellipsoidal-shaped) and has an axis of rotation extending through opposite ends of the mold member. This axis of rotation is coaxial with the aforementioned axis of rotation of the expandable bladder. More particularly, the mold member 41 comprises a generally ellipsoidal-shaped wall positioned between and integral with a pair of generally flat ends located at opposite ends of the mold member.

Each end of the mold member 41 has an opening formed therein, each opening having a center located along the axis of rotation of the mold member. The ellipsoidal-shaped wall of the mold member has two vertexes and two focal points extending along an axis generally perpendicular said axis of rotation of the mold member. This construction defines the shape of the expandable bladder 13. The ends of the mold member 41 lie in a plane generally parallel to the axis upon which said vertexes and focal points of the ellipsoidal-shaped wall lie. The end caps 22 are mounted at the ends of the mold member and form a part of the mold as shown in FIG. 2 to close the open ends of the mold member 41. The valve 27 (and its reinforcement patch 29) also are part of the mold member 41.

The mold member 41 is then mounted on a mandrel 39 in the manner illustrated in FIG. 12. As shown, the mandrel extends along an axis which is coaxial with respect to the axis of rotation of the mold member. As discussed above, each end cap 22 has an axial threaded opening for engaging a threaded arm of the mandrel 39 for mounting the mold member 41 on the mandrel. The mandrel is driven by a drive (not shown) for rotating the mold member about its axis of rotation.

The mold member 41 is then coated with the aforementioned fluid impermeable, non-porous material to form the expandable bladder 13 of the bag. This coating step may be accomplished by spraying or painting the rubber material onto the mold member 41. As illustrated in FIG. 2, the bladder 13 extends over the flange 22*b* of each end cap. Due to the material of the bladder (i.e., rubber), the bladder adheres to the end caps. As noted above, the valve 27 (and its reinforcement patch 29) and end caps 22 are part of the mold member and the rubber material is applied onto the mold member with the valve 27 and end caps 22 in place.

Figure 10:
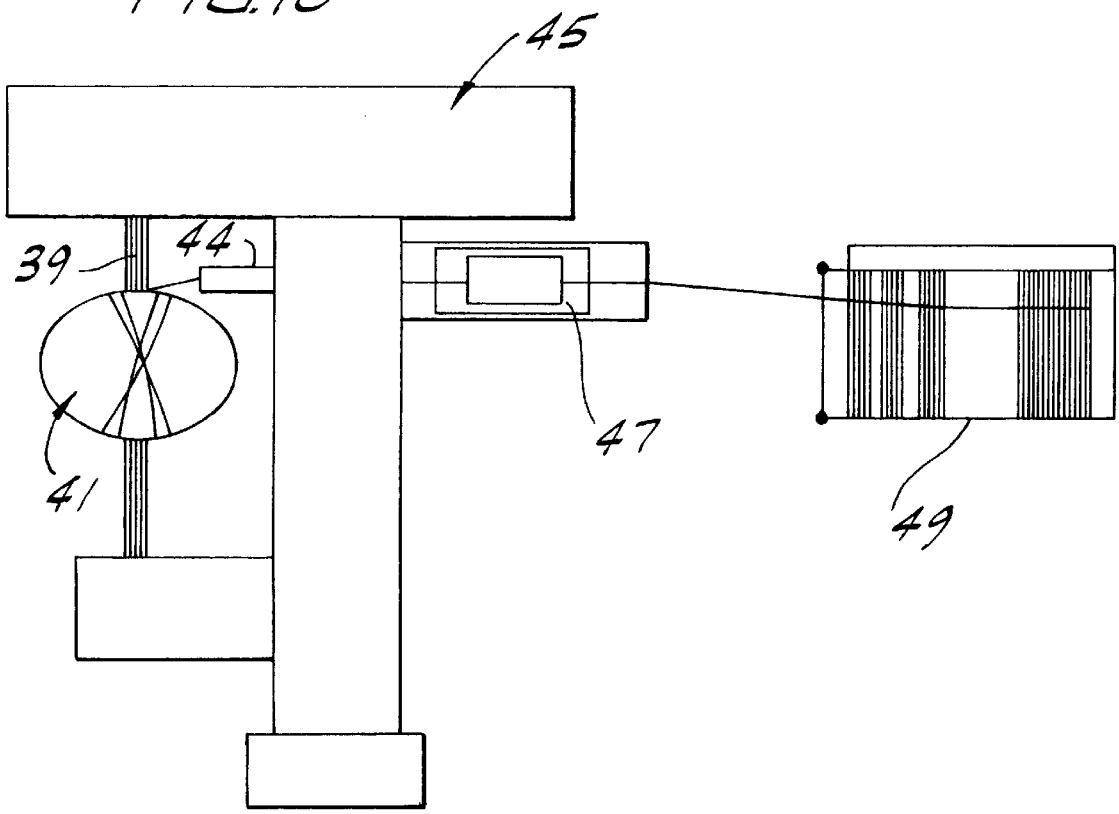
FIG. 10 is a schematic view of an apparatus for manufacturing the bag of the present invention.

Next, the first layer 15 and second layer 17 of strands (fabricated from aramid) are wound in succession onto the mold member 41 over the expandable bladder 13. By rotating the mandrel 39, the first layer 15 of strands are wound onto the mold member over the expandable bladder. The second layer 17 of strands are then wound onto the mold member 41 over the first layer 15 of strands. The first and second layer of strands, before being wound onto the mold member over the expandable bladder, are impregnated at 47 (FIG. 10) with rubber before feeding the strands onto the mold member 41 for adhering the strands of the first layer 15 to the expandable bladder 13 and for adhering the strands of the second layer 17 to the strands of the first layer (and portions of the expandable bladder not covered by the strands of the first layer).

The production of the bag according to the invention can preferably be done by winding the strands around a rotation symmetric mold member 41 having the required shape. A suitable feeding mechanism (FIG. 10), generally indicated at 45, is provided for feeding strands from a spool 49 to the bath of rubber 47 and onto the mold member 41. The feeding mechanism 45 includes a feed arm 44 located adjacent the mold member 41. The feed arm moves axially back and forth (as the mandrel 39 rotates) from one end of the mold member to the other end of the mold member for winding the strands onto the mold member. The mechanism 45 is constructed for winding multiple strands onto the mold member 41 simultaneously. The second layer 17 of strands are twisted before being wound onto the mold member.

After winding the second layer 17 of strands onto the mold member 41, the resistance layer 19 is applied to the mold member over the second layer of strands for protecting the expandable bladder 13. More specifically, neoprene is sprayed onto the mold member. As mentioned above, this resistance layer protects the expandable bladder against penetration by foreign objects.

Once the resistance layer 19 is applied to the mold member 41, the mold member (and the bag) is removed from the mandrel 39 and the mold member is removed from the expandable bladder 13. Since the mold member comprises sand, the mold member may be broken apart and removed from bag through the openings formed in the ends of the bag.

Another way of manufacturing the bag 11 of the present invention is to provide a sand mold 41 as described and wind the first layer 15 and second layer 17 of strands directly onto the sand mold, coat the layers of strands with the resistance layer 19 and remove the mold member 41 from the mandrel 39. The mold member may then be broken apart and removed through the openings at the ends of the bag whereupon an inflatable, expandable bladder 13 may be inserted into a cavity formed by the first and second layer of strands and the resistance layer.

After the mold member 41 is removed from the bag, two annular disks 23, one for each opening of the bag at opposite ends of the bag, are mounted onto the expandable bladder 13 in a position such that each annular disk 23 overlies and adheres to the edges of the resistance layer 19, first layer 15 and second layer 17 and the expandable bladder 13. Thus, these layers of the bag are positioned between each end cap 22 and its annular disk 23. As discussed above, the annular disks provide a larger loading surface area thereby enhancing the bag's lifting capacity.

Each end plate 25 is then threaded into its respective end cap 22 in a position such that the flange 25*b* of the end plate overlies the annular disk 23. The end plate 25 applies a force onto the annular disk 23 for sandwiching the annular disk, resistance coating 19, first layer 15 and second layer 17 of strands and the bladder 13 between the end plate and the end cap. In situations where only one bag is being used, the end plate does not have an opening formed therein. In situations where a number of bags are stacked upon one another, a solid or tubular rod 31 is inserted into the opening formed in each end plate attachment to an end plate 25 of another bag. The solid rod blocks communication between bags whereas the tubular rod allows fluid communication between bags.

The next step in the preferred method of manufacturing the bag 11 is to flatten the bag by bringing opposite ends of the bag towards on another. The flattened bag (see FIG. 1*a*) is then vulcanized by heating it between 120° C. to 130° C. to cure the rubber of the bag. This is the only vulcanizing step. Suitably the vulcanization takes place in flat condition. This resultant shape of the bag in deflated condition is flat, so that the lifting bag does not require much vertical space in deflated condition. This is of importance when the lifting bag has to be applied in areas where there is not much room, for example in collapsed buildings or after airplane, train or car crashes. When pressurized, the expandable bladder 13 will be deformed elastically, until the inflated equilibrium shape has been reached.

Figure 9:
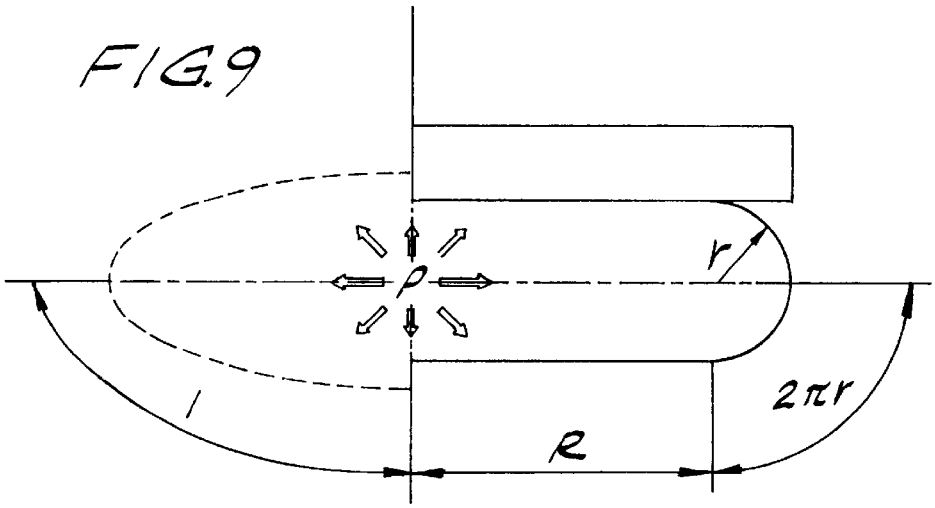
FIG. 9 is a schematic view of the bag of FIGS. 1–3 showing the effect of the external loading on the shape of the bag.

Depending on the wound shape of the bag 11, which is suitably generally ellipsoidal-shaped, a wide range of pressures can be applied to it, depending on filament type and quantity. It is generally possible to have one shape of bag that can be used for either high pressures or low pressures. Generally pressures between 0.1 bar (g) and pressures higher than generally used at present are possible. Pressures higher than about 50 bars (g) are seldom used. In the attached FIG. 9 the effect of the external loading on the shape of the bag is shown. It is to be understood that other ellipsoidal-shaped configurations other than the shape shown in the drawings may be used as well.

It is possible to construct the inflatable bag according to the invention in such a manner that the strands and bladder are completely airtight, so that no inner pressure bag is necessary. This puts some heavy requirements on the construction of the ends of the strands. The ends of the strands, as mentioned above, can be strengthened, for example, by concentrating more strands in the region of the ends. It is also possible to reinforce the ends with a closure from a suitable plastic or metal. It is to be noted that it is also possible to construct a lifting bag having a closed end, especially in case of completely airtight bags, without inner pressure bag. Depending on the use of the inflatable bag, the ends may provide protection against damages due to penetrating shapes in the environment. The ends may be provided with an inlet and/or outlet for the pressurizing medium, provided this does not interfere with the functioning of the inflatable bag. In case the ends act also as area where the lifting force is exerted, it may be advantageous to provide the valve 27 at a different place. In case of separate strengthening of the ends, the strengthening may be discontinuous with respect to the reinforced bag.

As discussed above, the fabrication of the strands of the bag can take place in various ways. A suitable method as disclosed herein is winding a layer of impregnated strands around the bladder 13, optionally followed by further impregnation of a second layer of strands. However, it is also possible to apply the bladder 13 to the mold member 41 prior to the winding of the strands or after the winding of the strands. After the layers of strands have been wound around the mold member, the mold member is removed. This can be done as described in detail above by using a mold member that collapses in parts, by a temporary core composed of loosely bound solids or an inflatable core.

Figure 13:
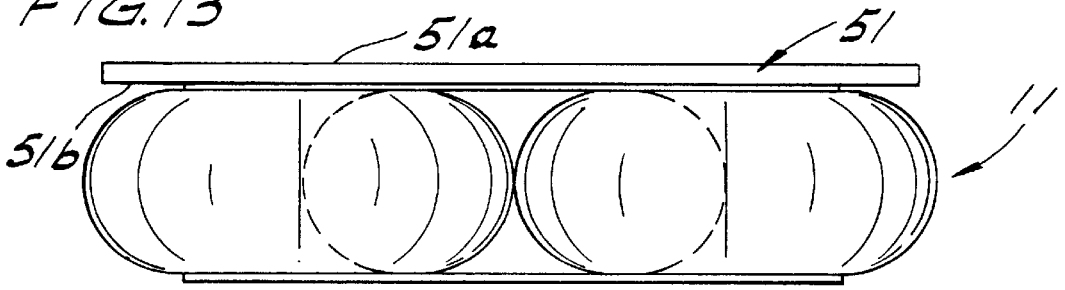
FIG. 13*a* is a top view illustrating a lifting apparatus incorporating three bags and a platform.
FIG. 13*b* is a side view illustrating a lifting apparatus incorporating seven bags cascaded together in three layers with a platform connecting the lower two layers.
Figure 13A:
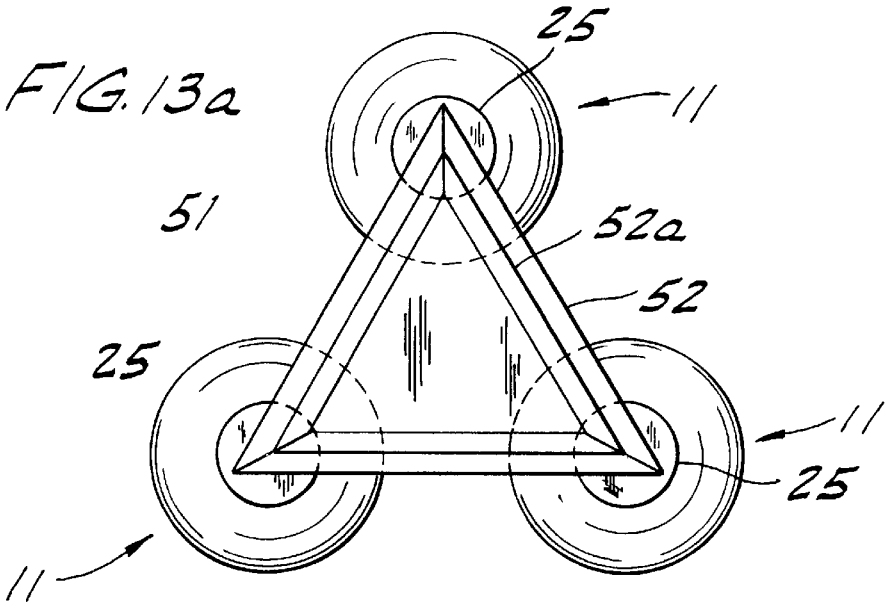
Figure 13B:
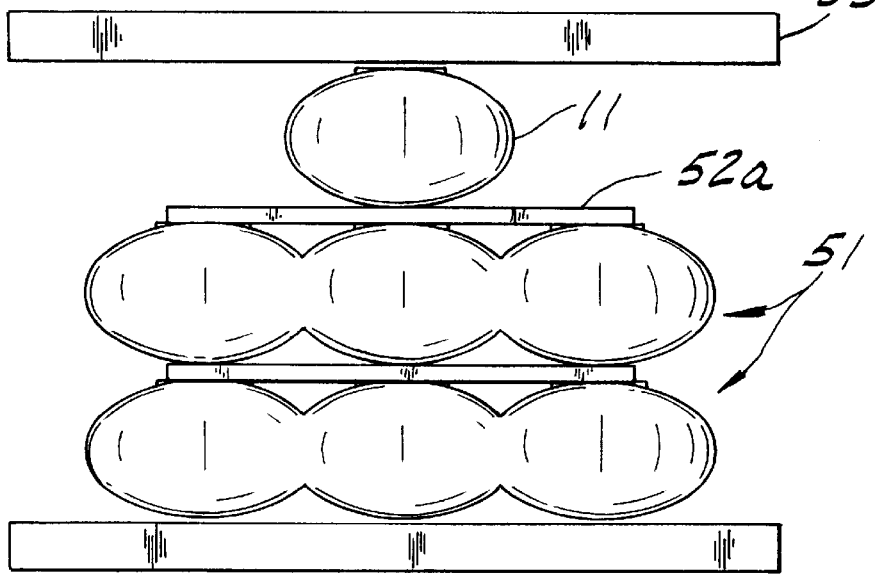

FIGS. 13*a* and 13*b* illustrate an apparatus having a plurality of bags of the construction as described above which are used for lifting and positioning objects. In FIG. 13*a*, a tripod frame assembly 51 is shown comprising three such bags 11 having top end plates 25 connected together by a triangular, flat, rigid platform 52, having a top surface 52*a* adapted to engage an object and a bottom surface engaging the top end plates 25 of the bags. In FIG. 13*b*, two tripod frame assemblies 51 are stacked one on top of the other in a cascaded arrangement with a single bag 11 positioned between the top surface 52*a* of the top platform and an object 53 to be moved. This arrangement provides a larger vertical lifting distance and allows different inflating pressure to be used in different layers. For example, the single top bag 11 may be only partially inflated to provide horizontal stability and a large surface area for engaging object 53 whereas assemblies 51 may have fully inflated bags.

The bags of the present invention have sufficient horizontal stability so that when arranged in such a configuration as shown in FIGS. 1*b*, 13*a* or 13*b*, the configuration is capable of vertically lifting objects having large surface areas. In contrast, prior art bags do not have such horizontal stability. If prior art bags were used in the tripod frame assembly of FIG. 13*a* or the cascade assembly of FIG. 13*b*, as the prior art bags are vertically inflated, the platforms 51 would tend to slide horizontally and move to the side rather than vertically lifting the platform 51.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A geometrically-shaped bag for lifting and positioning objects comprising:

a layer of fluid impermeable, non-porous material forming an expandable bladder having opposite ends, each having an opening;

a first layer of wound strands enclosing the expandable bladder, said first layer of wound strands symmetrically constructed and arranged about the opposite ends and each strand passing through the opposite ends, whereby said strands are on the expandable bladder such that each strand of the first layer of strands is substantially equally tensioned, and wherein the inflated bladder and the enclosing first layer form a geometrically continuous surface having a non-spherical, non-cylindrical shape; and end means positioned within each opening for engaging both the fluid impermeable layer and the first layer and for sealing the openings so that the bladder forms a closed chamber.

2. A bag as set forth in claim 1 wherein the bladder has a substantially circular cross section in a horizontal plane and a substantially elliptical cross section in a vertical plane when the bag is inflated and further comprising a second layer of wound strands enclosing the first layer of strands wherein said first and second layers of strands are constructed and arranged to be wound substantially along geodetic lines on the expandable bladder whereby each strand of the first and second layers of strands is substantially equally tensioned and there is a reduction in the possibility of catastrophic failure of the bag when the inflated bladder and the first and second layers of strands are punctured.

3. A bag as set forth in claim 2 wherein said first and second layers of strands form a concentrated area around said ends of the expandable bladder, said area defining the opening at each end of the expandable bladder into which the end means is positioned.

4. A bag as set forth in claim 2 further comprising a resistance layer applied over the second layer of strands for protecting the strands and the expandable bladder.

5. A bag as set forth in claim 4 wherein said expandable bladder comprises a sprayed layer of said material formed over a geometrically-shaped mold member having an axis of rotation extending through opposite ends of the mold member corresponding to the ends of the expandable bladder so that the bladder has a shape of mold member.

6. A bag as set forth in claim 5 wherein said mold member comprises a generally ellipsoidal-shaped wall positioned between and integral with the two ends of the mold member, said ellipsoidal-shaped wall having two vertexes and two focal points extending along an axis generally perpendicular said axis of rotation of the mold member and wherein the bladder has the same shape as the mold member.

7. A bag as set forth in claim 6 wherein said ends of the mold member lie in a plane generally parallel to said axis upon which said vertexes and focal points of the ellipsoidal-shaped wall lie and wherein the bladder has the same shape as the mold member.

8. A bag as set forth in claim 4 wherein each end of said expandable bladder has the opening formed therein coaxial with an opening formed in the strands, each opening having a center located along an axis extending through said ends, and wherein the bag further comprises two end caps, one for each end of the expandable bladder, adhered to an inner surface of the expandable bladder for closing said openings.

9. A bag as set forth in claim 8 wherein each end cap has an axial threaded opening formed therein; and further comprising two annular disks, one for each end of the expandable bladder, mounted onto the expandable bladder in a position such that edges of the resistance layer, first and second layers and the expandable bladder are positioned between each end cap and its associated annular disk, said annular disks being adapted to strengthen the ends of the expandable bladder thereby enhancing its lifting capacity, and two end plates, one for each end of the expandable bladder, threaded into respective end caps, each end plate having a flange overlying the annular disk for sandwiching the annular disk, resistance layer, first and second layers of strands and said expandable bladder between the end plate and said end cap.

10. A bag as set forth in claim 9 wherein one of said end plates comprises an upwardly-facing, shaped adapter contoured to receive a shaped object for lifting said object, said object resting upon the adapter.

11. A bag as set forth in claim 9 wherein said end plates are made from aluminum and wherein each end plate has a threaded opening formed therein.

12. A bag as set forth in claim 11 wherein said expandable bladder comprises a chamber adapted to receive fluid for expanding the bladder, and wherein each end plate opening is adapted to receive a rod for attaching the end plate to an end plate of a second bag in a position such that the first bag rests upon the second bag, said chamber of the first bag being isolated from said chamber of the second bag.

13. A bag as set forth in claim 11 wherein said expandable bladder comprises a chamber adapted to receive fluid for expanding the bladder, and wherein each end plate opening is adapted to receive a rod for attaching the end plate to an end plate of a second bag in a position such that said second bag rests upon the first bag, said rod attaching the first bag to the second bag being of tubular construction, the chamber of the first bag being in fluid communication with a chamber of the second bag so that the first bag is pressurized with fluid to a pressure substantially equal to the pressure of the second bag.

14. A bag as set forth in claim 9 wherein a group of bags are positioned adjacent one another, and further comprising a platform engaging the end plates of the top ends of said bags, said bags and platform being provided for lifting an object resting on said platform by lifting the platform.

15. A bag as set forth in claim 4 wherein the bag has a substantially flat shape in a deflated condition so that opposite ends of the bag are adjacent one another, whereby said bag is vulcanized when in its flat, deflated condition for curing the expandable bladder and resistance layer.

16. A bag as set forth in claim 4 wherein said expandable bladder comprises an ellipsoidal-shaped wall positioned between the two ends of the expandable bladder, said ellipsoidal-shaped wall having two vertexes and two focal points extending along an axis generally perpendicular an axis of rotation extending between the two ends of the expandable bladder.

17. A bag as set forth in claim 16 wherein said ends of the expandable bladder lie in a plane generally parallel to said axis upon which said vertexes and focal points of the ellipsoidal-shaped wall of the expandable bladder lie.

18. A bag as set forth in claim 16 wherein said expandable bladder comprises an elastomeric material, and wherein the bag is filled with non-compressible fluid.

19. A bag as set forth in claim 1 comprising:

a plurality of additional bags having bottom and top ends, said additional bags being positioned adjacent one another and adjacent said geometrically-shaped bag; and a platform having a top surface adapted to engage an object for lifting and positioning the object and a bottom surface engaging the top ends of said additional bags and said geometrically-shaped bag.

20. A geometrically-shaped bag for lifting and positioning objects and for filling voids, said bag comprising a fiber reinforced elastomer body having a seamless wall which in its uninflated condition has a substantially flat shape and in its inflated condition has a shape which is at mechanical equilibrium, said bag including a first layer of wound strands enclosing the expandable bladder, said first layer of wound strands symmetrically constructed and arranged about an axis defined by and passing through its opposite ends, whereby said strands are on the expandable bladder such that each strand of the first layer of strands is substantially equally tensioned, and wherein the inflated bladder and the enclosing first layer form a geometrically continuous surface having a non-spherical, non-cylindrical shape; and end means positioned within each opening for engaging both the fluid impermeable layer and the first layer and for sealing the openings so that the bladder forms a closed chamber.

21. Inflatable body comprising a fiber reinforced elastomer body which has a flat shape in a non-inflated condition and which has a mechanical equilibrium shape in an inflated condition, said body being predominantly geometrically continuous, non-spherical and non-cylindrical, characterized in that, in said inflated condition, said body has the shape of an oblate sphere with continuous curved edges, and that said body also has poles with openings therein, which are strengthened and closed by polar end caps.

* * * * *